United States Patent [19]

Hayes

[11] 4,290,712

[45] Sep. 22, 1981

[54] PLASTIC POST APPARATUS AND METHODS

[76] Inventor: Norman J. Hayes, P.O. Box 618, Cody, Wyo. 82414

[21] Appl. No.: 26,100

[22] Filed: Apr. 2, 1979

[51] Int. Cl.[3] ..... E01F 9/01

[52] U.S. Cl. ..... 404/10; 256/1; 256/13.1; 52/297

[58] Field of Search ..... 404/10, 9, 11; 40/607, 40/608, 612; 52/297; 256/13.1, 1, DIG. 5

[56] References Cited

U.S. PATENT DOCUMENTS

| | | | |
|---|---|---|---|
| 127,987 | 6/1872 | Putnam | 256/DIG. 5 |
| 261,230 | 7/1882 | Hugill | 256/DIG. 5 |
| 759,838 | 5/1904 | Willmarth | 256/DIG. 5 |
| 913,402 | 2/1909 | Knickerbocker | 52/297 |
| 994,742 | 6/1911 | Gregory | 52/297 |
| 1,632,965 | 6/1927 | Hays | 256/DIG. 5 |
| 3,380,428 | 4/1968 | Abrams | 404/10 X |
| 3,863,595 | 2/1975 | Barnett | 404/10 X |
| 3,891,189 | 6/1975 | Russo | 256/1 |
| 4,123,183 | 10/1978 | Ryan | 256/1 X |
| 4,156,332 | 5/1979 | Thompson | 52/297 X |

FOREIGN PATENT DOCUMENTS

| | | | |
|---|---|---|---|
| 50647 | 10/1966 | Fed. Rep. of Germany | 404/10 |
| 1255128 | 11/1967 | Fed. Rep. of Germany | 404/10 |
| 1459830 | 2/1968 | Fed. Rep. of Germany | 404/10 |
| 1286060 | 1/1969 | Fed. Rep. of Germany | 404/10 |
| 2343877 | 7/1977 | France | 256/DIG. 5 |
| 1170948 | 11/1969 | United Kingdom | 404/10 |

*Primary Examiner*—Nile C. Byers, Jr.

*Attorney, Agent, or Firm*—Bruce G. Klaas; Richard D. Law; Dennis K. Shelton

[57] ABSTRACT

A post made of one piece of molded polymeric material having a vertically upwardly extending elongated post means portion for supporting apparatus mounted thereon; a driving head means portion connected to and mounted below the lower end of the post means portion for application of force thereto without application of force to the upper end of the post means portion for forcibly driving the post apparatus into the ground; stabilizing flange means portions mounted on the driving head means portion below the lower end of the post means portion for stabilizing and supporting the post apparatus in a vertical attitude after being forcibly driven into the ground; and a ground penetrating shaft means portion connected to and mounted below the stabilizing means portion for initial penetration of the ground during forcible driving of the post apparatus into the ground.

29 Claims, 21 Drawing Figures

97
60
26
96
26
69
56
98
54
23
61
62
66
63
24
69
85
86
75
76
72
68
92
91
83
20
43
40
46
5
5
41
44
38

59
58
60
97
26
69
26
96
98
56
80
79
57
23
54
63
62
64
6
6
72
74
24
69
81
68
93
82
86
7
7
92
83
84
46
42
40
20
47
43
38

20
38
50
51
48
22
49
50

Fig-12
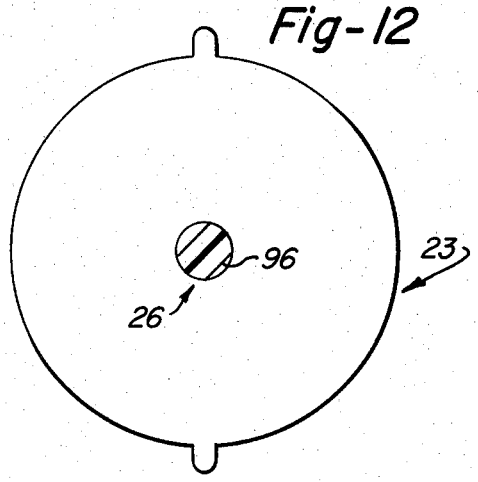
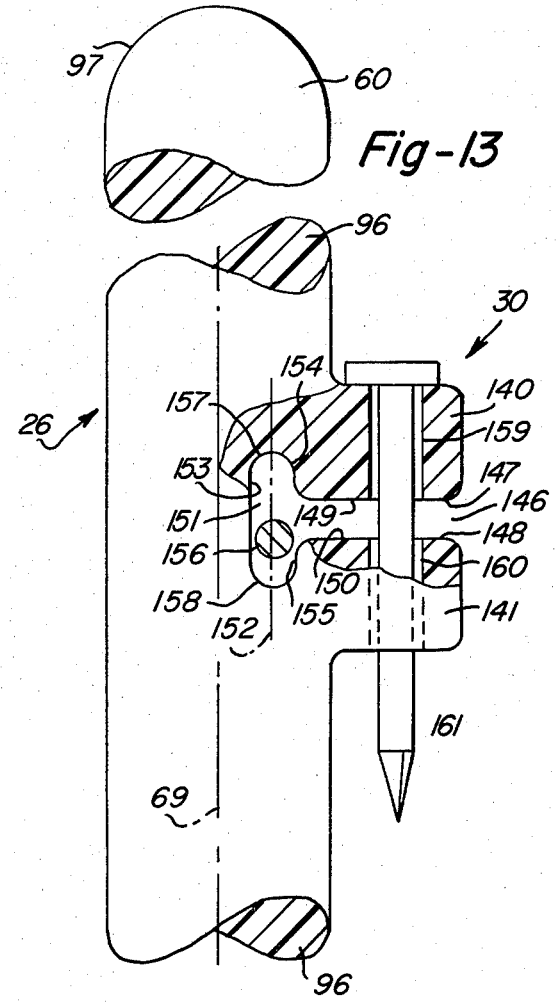
Fig-13
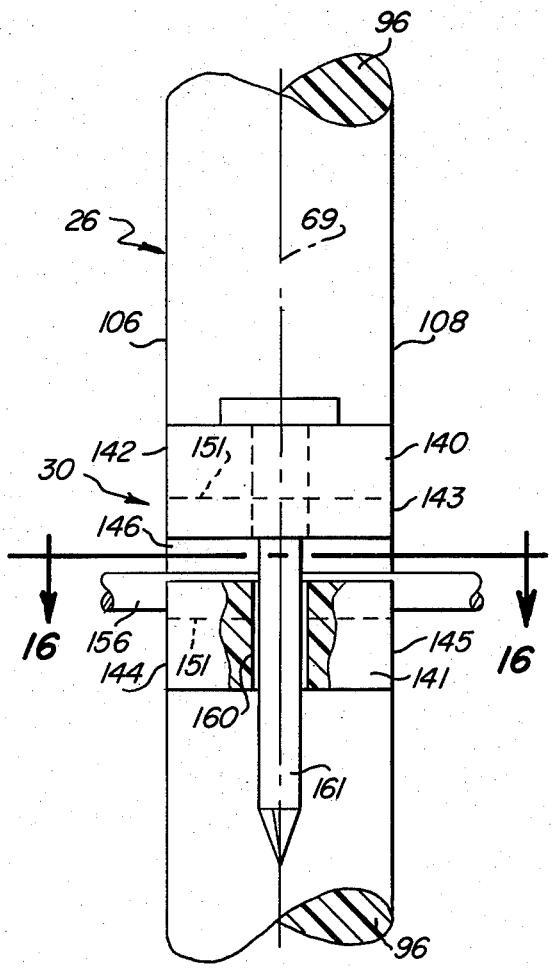
Fig-14
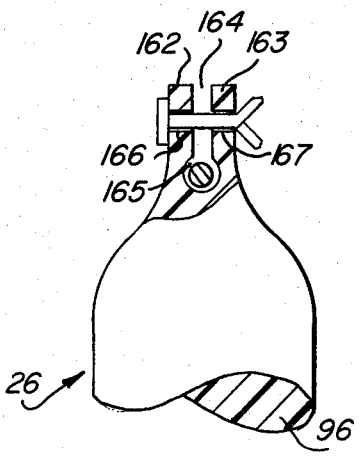
Fig-15

Fig-16
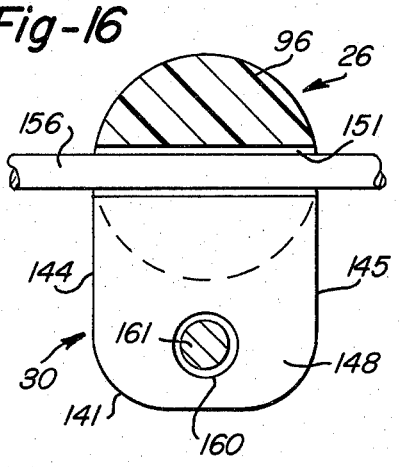
Fig-17
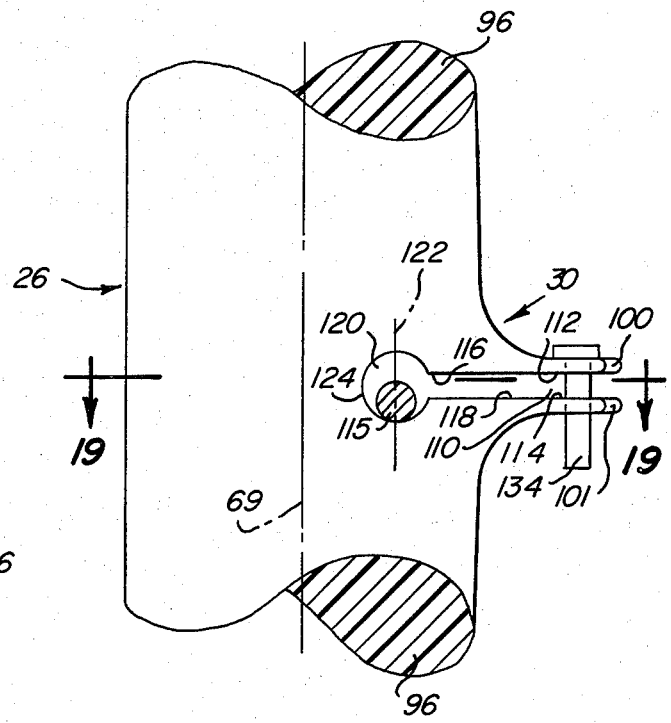
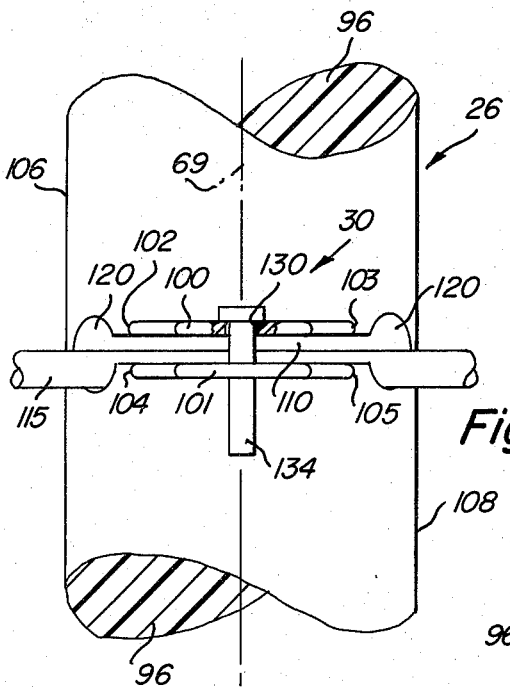
Fig-18
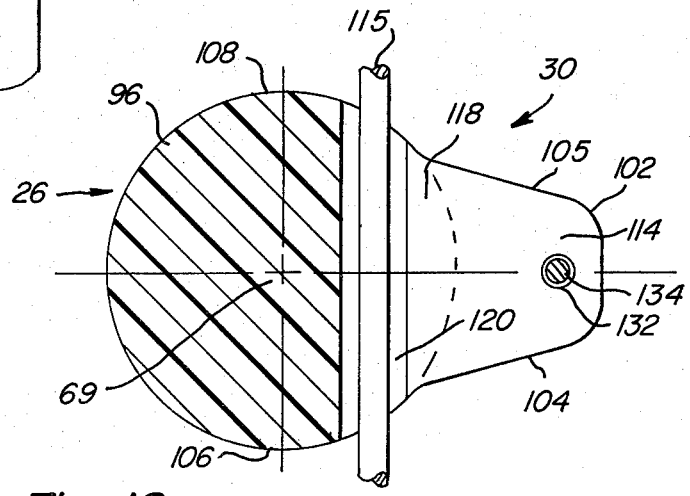
Fig-19

PLASTIC POST APPARATUS AND METHODS

BACKGROUND AND SUMMARY OF INVENTION

This invention relates to improvements in the construction and manufacture of posts and, more particularly to the construction and manufacture of fence posts and highway posts.

For many years, various attempts have been made to make fence and road type posts, as well as other types of post and marker devices, from plastic materials as illustrated by the following U.S. Pat. Nos: Lach 2,821,365; Bellamy 2,976,346; Pilbouis 3,080,149; Byrd 3,091,997; Baumeister 3,378,967; Cuthbert 3,385,565; Blease 3,700,213; Ebinger 3,709,112; Loch 3,720,401; Hellerich 3,740,024; Bartlett 3,776,522; Weichenrieder 3,802,135; Lamarre 3,875,699; Russo 3,891,189; Fornells 3,910,561; Murphy 3,957,250; Deike 4,021,977; Parduhn et al 4,032,248; Schmanski 4,061,535; Minor et al 4,070,007; Ronden 4,078,867; and Humphrey 4,084,914.

Despite the prior effects of others, most commercially acceptable fence posts and highway sign and marker posts continue to be made of T-shaped rigid steel construction. Such posts are relatively heavy and expensive. In highway usage, such posts pose a substantial safety hazard when accidentally struck by vehicles. Such accidents not only can cause substantial damage to the vehicle but may also cause the driver to lose control of the vehicle and, in many cases, the steel posts have punctured the vehicle gas tank leading to fire and explosion. In electric fence post usage on farms and ranches, the conductivity and rigidity of the posts cause problems in the requirements of use of insulator wire mounting devices and in breakage of the wire or disconnection of the wire from the mounting devices under load such as applied by animals against the wire.

While the foregoing problems have been long recognized and the use of plastic materials for posts has previously been suggested, the present invention utilizes the following different concepts than the known prior art:

1. The posts have a monolithic structure made from a suitable thermosetting plastic material or the like.

2. The posts are of solid cross-sectional configuration which may be of relatively small cross-sectional area including cylindrical portions of between ½ inch and 2 inches with ¾ inch to 1¼ inch size being presently preferred for fence line and sign and marker posts while fence corner or anchor brace or other types of posts may be of larger diameter.

3. The posts have integral ground penetration means, stabilization means and driving means integrally molded thereon.

4. The posts have integral attachment devices preferably integrally molded therewith or, alternatively, integrally associated therewith.

5. The posts are flexible under high load while being sufficiently rigid to perform the intended function during normal use.

The post of the presently preferred embodiment of the invention is made of one piece of molded plastic material, polyurethane being presently preferred, comprising: a ground penetrating lower portion; an intermediate stabilizer and driving head portion next adjacent the penetrating portion; and an elongated upper post portion which may have various attachment means thereon such as longitudinally spaced fence wire attachment devices for fence post usage with various kinds of fence wires which may be electrified or sign and/or reflector devices for road sign and marker usage.

BRIEF DESCRIPTION OF DRAWING

Presently preferred and illustrative embodiments of the invention are shown in the accompanying drawing in which:

FIG. 12 is a reduced cross-sectional view taken along the line 12—12 in FIG. 8;

FIG. 13 is a side elevational view, partially in section, of an upper end and intermediate portion of a post having one form of wire attachment means device with a fence wire and retaining pin mounted therein;

FIG. 14 is another side elevational view of the intermediate post portion of FIG. 13;

FIG. 15 is a partial side elevational view of an alternative upper end portion of a fence post;

FIG. 16 is a cross-sectional view of the post portion of FIG. 14 taken along line 16—16;

FIG. 17 is a side elevational view of an intermediate fence post portion having an alternative wire attachment means device;

FIG. 18 is another side elevational view of the fence post portion of FIG. 17;

FIG. 19 is a cross-sectional view taken along the line 19—19 in FIG. 18;

DETAILED DESCRIPTION

In General

Figure 1:
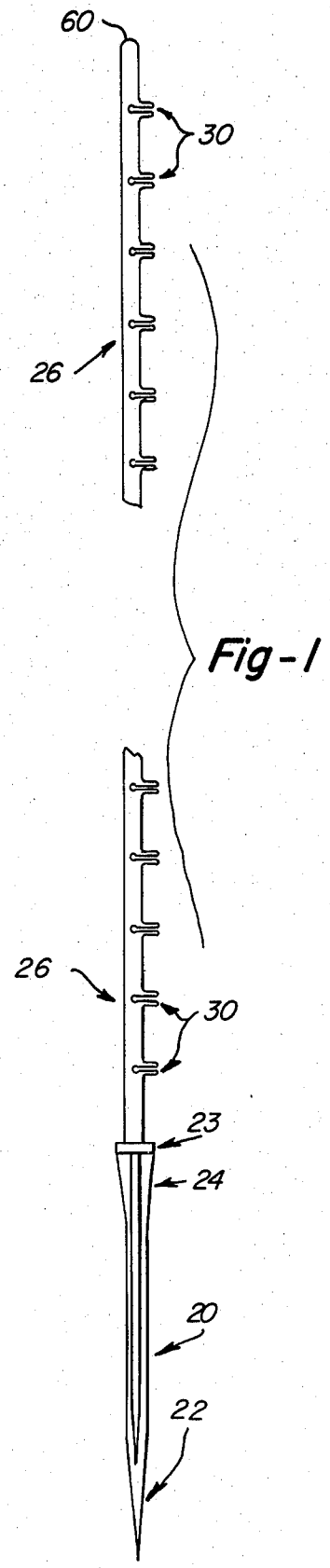
FIG. 1 is a side elevational view of a fence type post having the general features of the present invention and wire attachment devices.

As shown in FIGS. 1 and 8–10, in general, the posts of the present invention are made of molded polymeric material such as high strength, high impact resistant, high and low temperature resistant, tough and durable polyurethane. Each of the posts comprises an elongated ground penetrating lower shaft means portion 20 terminating in a lowermost tapered penetrating tip means portion 22; a combination driving head means 23 and stabilizer means portion 24; and an elongated post means portion 26 which, in the fence post embodiment of FIGS. 1–7 is provided with a plurality of longitudinally spaced integrally molded wire attachment means portions 30 of any suitable design, and in the road marker and sign post embodiment of FIGS. 8–11 is provided with an integrally molded reflector mounting means portion 32 at the upper end thereof and a sign mounting means portion 33 having a plurality of integrally formed longitudinally spaced sign attachment devices of any suitable design such as openings 34, 35, 36 therealong.

The Fence Post Embodiments

Figure 2:
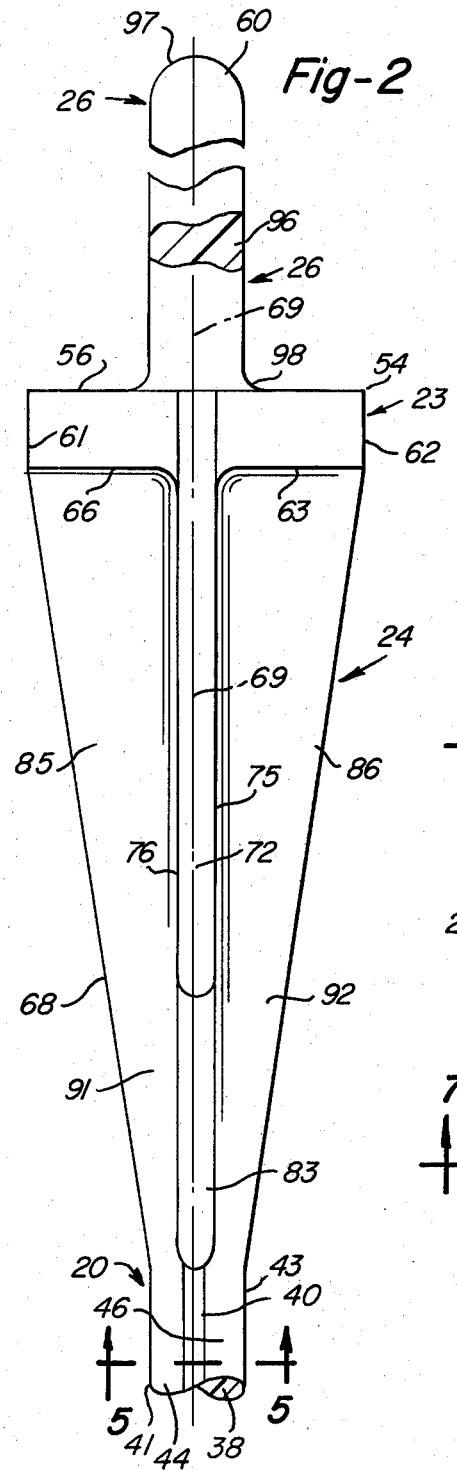
FIG. 2 is an enlarged side elevational view of the post of FIG. 1, with parts removed, showing the end portion of the post, the stabilizer and driving head portions of the post, and a portion of the penetrating tip and shaft portion.

Referring now to FIGS. 2–7, the ground penetrating lower shaft means portion 20 has a solid center core 38 of generally cylindrical cross-sectional configuration suitable diameter, e.g. approximately $\frac{5}{8}$ to $\frac{3}{4}$ inch outside diameter and a suitable length, e.g. approximately 8 to 10 inches, preferably with alternating elongated ribs 40, 41, 42, 43 and grooves 44, 45, 46, 47, FIG. 2, equally circumferentially spaced about the periphery thereof. In the presently preferred embodiment, there are four ribs and four grooves with the radial center lines of the ribs circumferentially spaced 90! from one another.

Figure 3:
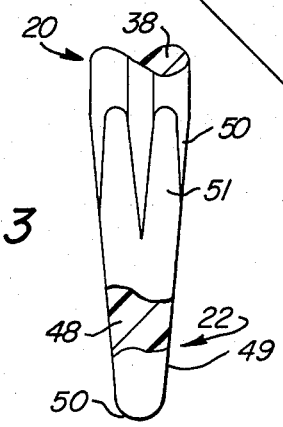
FIG. 3 is an enlarged side elevational view of the lower tip portion of the post of FIG. 1.

The ground penetrating tip means portion 22, FIG. 3, has a tapered solid center core 48 providing an elongated conical peripheral surface 49 which terminates in a suitable rounded end surface 50, e.g. approximately $\frac{1}{8}$ to 5/32 inch radius, and has a suitable length, e.g. approximately 2 to 4 inches. The lowermost portions 50, 51 of the ribs and grooves continue along the upper part of tip portion 22 to merge with the conical outer surface 49 approximately halfway from end surface 50.

Figure 4:
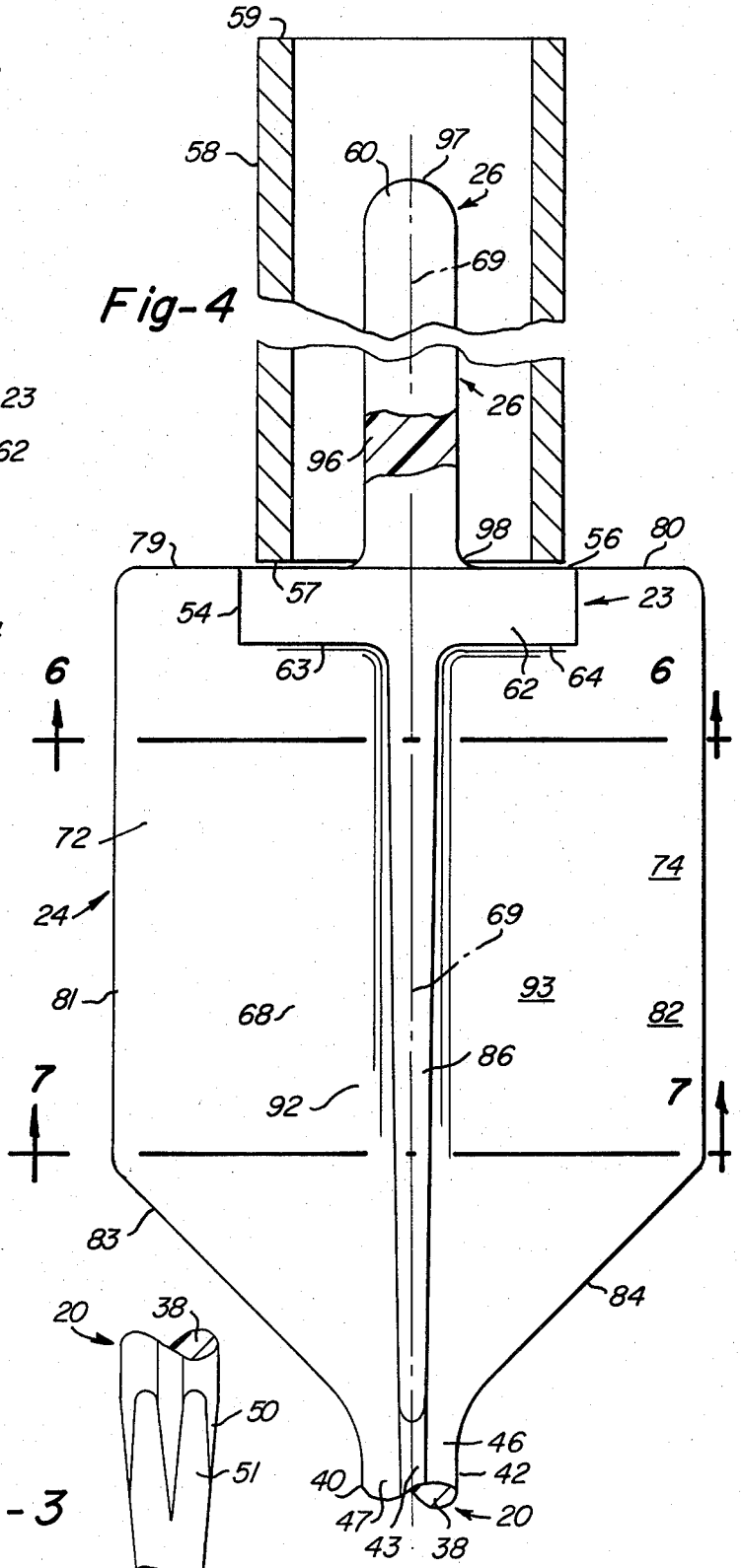
FIG. 4 is another side elevational view of the post portions shown in FIG. 2.

The driving head means portion 23, FIGS. 2 & 4–7, comprises a cylindrical solid core head portion 54 of suitable diameter, e.g. 2 to 3 inches, and suitable axial length, e.g. $\frac{1}{2}$ to 1 inch, having a flat annular upper side abutment surface 56 for abutting engagement with suitable post driving means in the form of a lower end surface 57 of a hollow annular driving device 58 of any suitable design, such as a length of metallic pipe of suitable outside diameter, having its upper end surface 59 located above the upper end 60 of the post portion 26 as illustrated in FIG. 4 or of shorter length with suitable force applying means to enable the post to be driven without application of force to the post portion 26. Head portion 54 has semi-cylindrical peripheral surfaces 61, 62 and flat lower side surface portions 63, 64, 65, 66. An elongated downwardly inwardly tapered enlarged solid center core portion 68 having a suitable taper, e.g. approximately 9° to 15°, relative to central longitudinal post axis 69 with a suitable length, e.g. approximately 4 to 5 inches, provides a generally conical core area 70.

Figure 6:
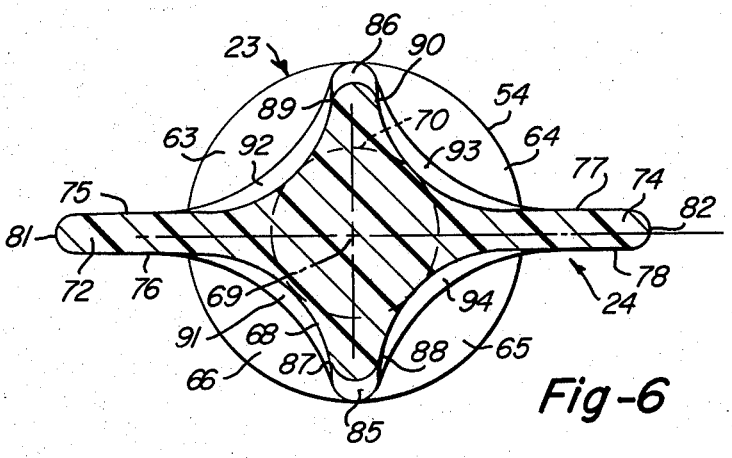
FIGS. 6 & 7 are cross-sectional views taken along lines 6—6, and 7—7 in FIG. 4.
Figure 7:
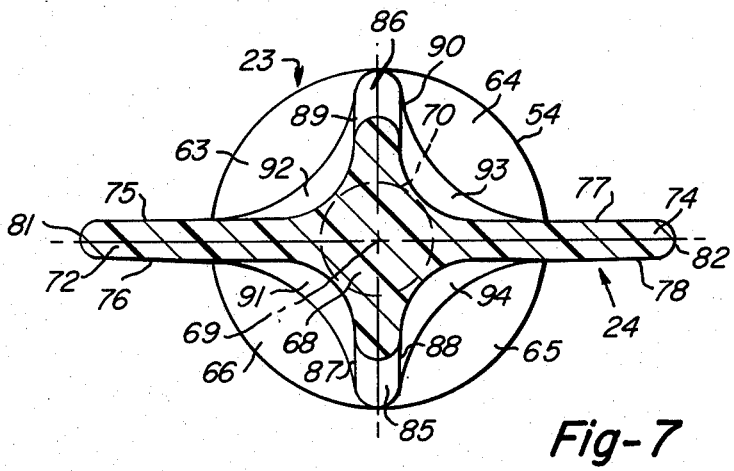
Figure 8:
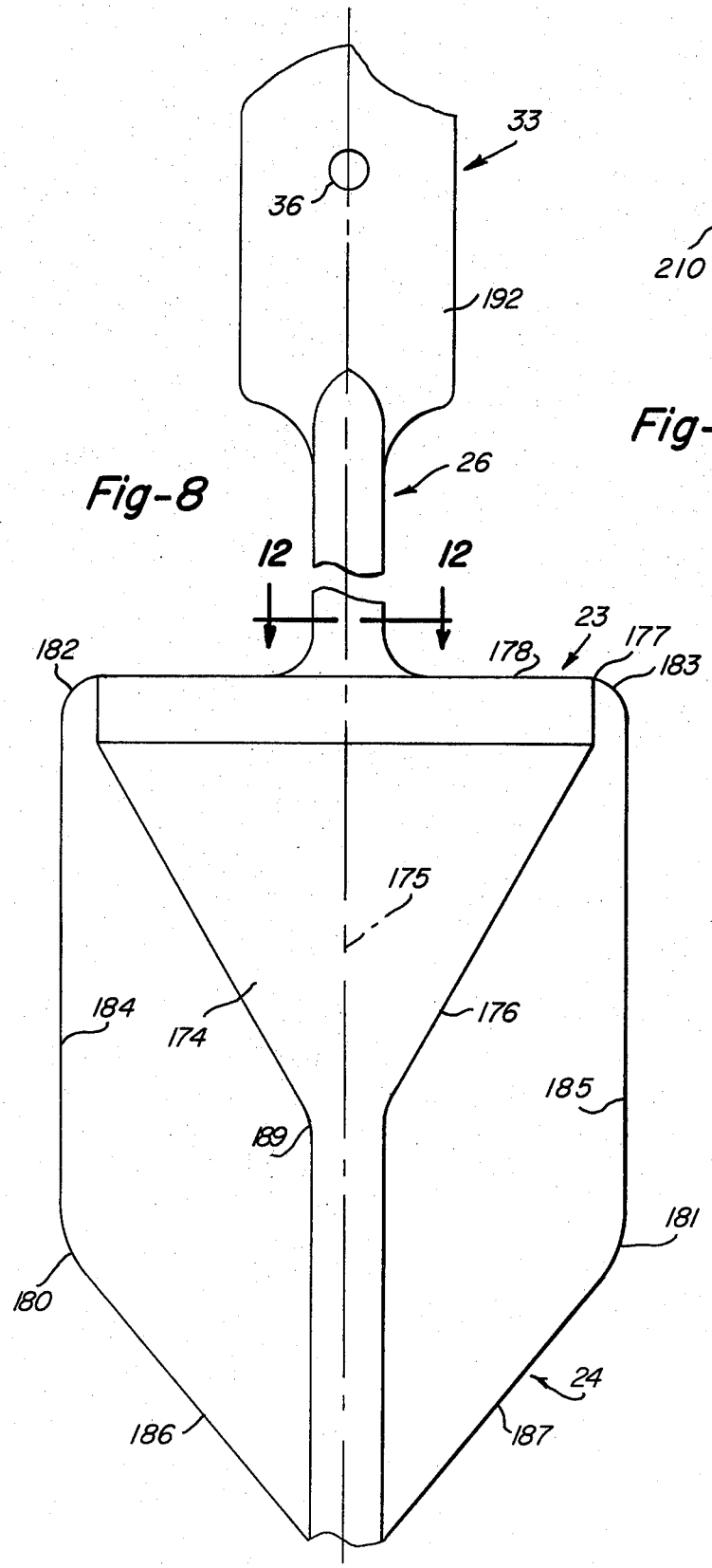
FIG. 8 is a side elevational view of a road marker and sign post embodiment of the invention, with portions removed, and illustrating means for driving the post into the ground.
Figure 9:
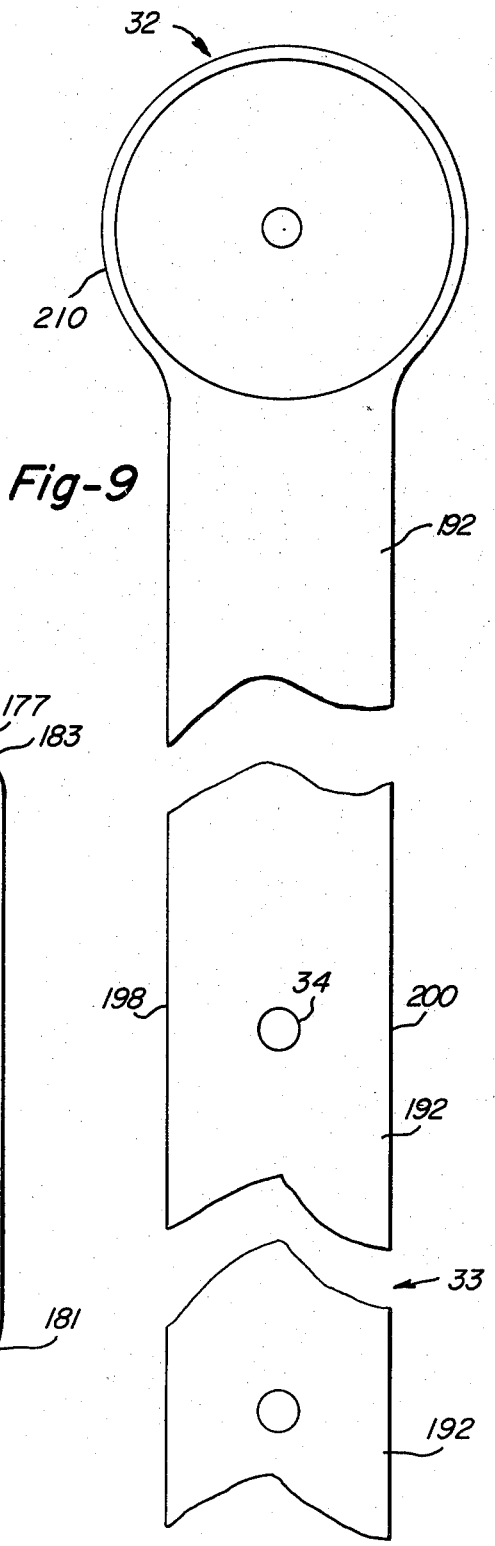
FIG. 9 is another side elevational view of a portion of the post of FIG. 8.
Figure 10:
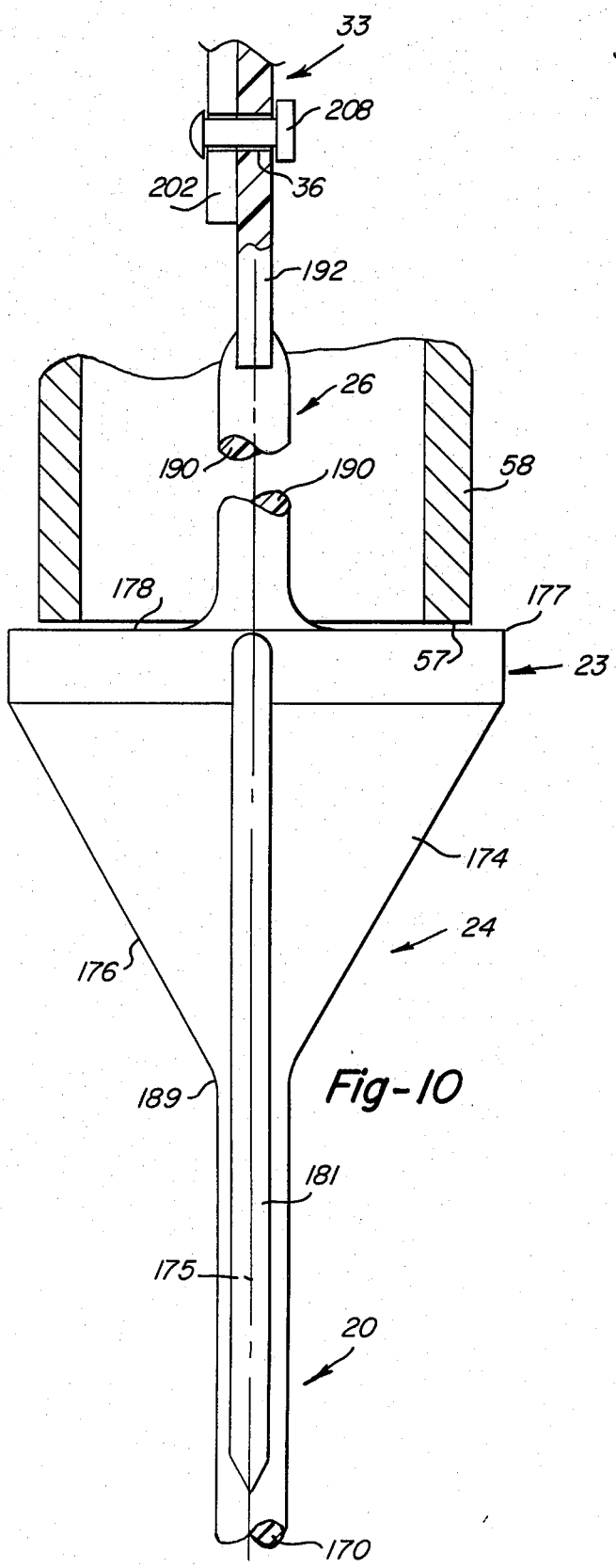
FIG. 10 is another side elevational view, partly in cross-section and with parts removed, of a lower portion of the post of FIGS. 8 & 9 with a road sign mounted thereon and a drive pipe associated therewith.
Figure 11:
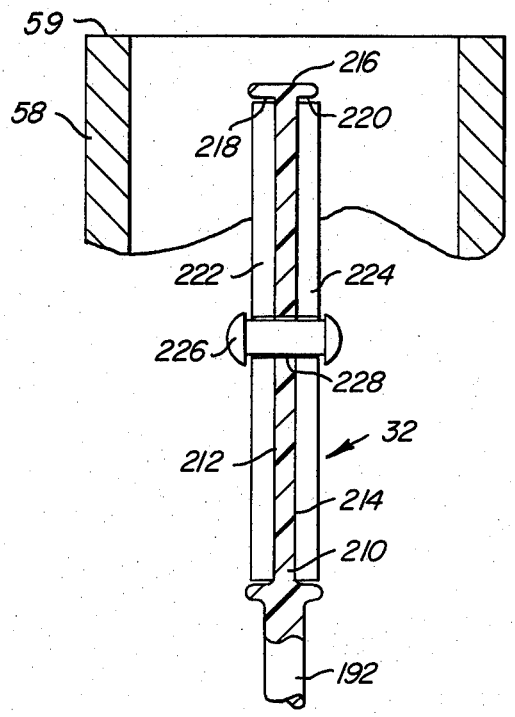
FIG. 11 is another side elevational view, partly in cross-section and with parts removed, of an upper portion of the post of FIGS. 8 & 9, with a road sign and marker mounted thereon and a drive ipe associated therewith.
Figure 11:
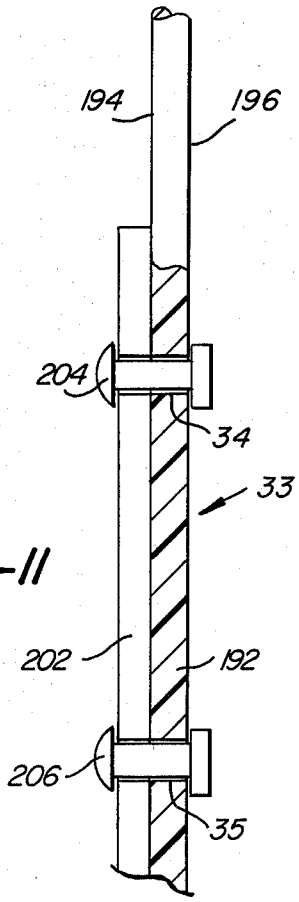

The stabilizer means portion 24 comprises a pair of radially outwardly extending diametrically opposite flange portions 72, 74 having flat planar slightly outwardly tapered side surfaces 75, 76 & 77, 78 with a relatively narrow width, e.g. approximately $\frac{1}{4}$ inch. Generally radially extending upper end surfaces 79, 80 extend outwardly from side surface 66 in generally coplanar relationship therewith and preferably are slightly downwardly tapered away therefrom. Side end surfaces 81, 82 extend generally parallel to the central longitudinal post axis 69 and lower end surfaces 83, 84 are inwardly inclined at an angle of approximately 60° relative to axis 69 and merge with rib portions 40, 42 on shaft portion 20 approximately six inches from surface 56. A pair of radially outwardly extending diametrically opposed downwardly inwardly tapered rib portions 85, 86 extend radially outwardly from the core area 70 between the head portion 54 and the shaft portion 20 with flat planar slightly outwardly tapered side surfaces 87, 88 and 89, 90 being downwardly inwardly tapered, as shown in FIGS. 6 & 7, so as to effect convergence and merger with rib portions 41, 43 on shaft portion 20. The stabilizing flange portions 72, 74 and the rib portions 85, 86 are connected by concavely curved surfaces 91, 92, 93, 94 extending downwardly inwardly from and intersecting lower surfaces 63, 64, 65, 66 of head portion 54 so as to converge and merge with groove portions 44, 45, 46, 47 on shaft portion 20. All surface intersections are connected by relatively large radius curved surfaces as illustrated.

The post means portion 26 comprises a cylindrical solid core 96 of suitable diameter, e.g. $\frac{5}{8}$ to $\frac{3}{4}$ inch, and suitable length, such as approximately $4\frac{1}{2}$ feet, coaxial with center axis 69 and, in one embodiment, terminates in a rounded semi-spherical end surface 97. The bottom of the post portion is integral with head portion 54 and connected to surface 56 by a suitably curved annular surface 98.

Referring now to FIGS. 17–19, another alternative form of the wire attachment means 30 comprises a pair of integral outwardly extending resiliently deflectable axially spaced flange portions 100, 101 having flat parallel laterally spaced side surfaces 102, 103 & 104, 105 which are inwardly offset relative to diametrically opposite surfaces 106, 108 of the cylindrical core 96. Flange portions 100, 101 are separated by a wire insertion slot 110 defined by opposed flat parallel flange surfaces 112, 114 which are preferably spaced apart a distance slightly less than the diameter of a fence wire 115 to be inserted therebetween, and opposed radial inwardly extended surfaces 116, 118 in post portion 26 which intersect a laterally extending wire retaining circular slot means 120 having a vertical center line 122 located at or adjacent to the central post axis 69. Slot means 120 comprises an annular passage having a cylindrical surface 124 with a diameter substantially greater than the diameter of wire 115 to be received therein to enable limited upward and downward displacement of the wire therewithin to accommodate stress on the wire due to variations in terrain and/or forces applied by animals and/or loads applied by ice and snow or the like. A pair of coaxial aligned pin holes 130, 132 are provided in flange portions 100, 101 to receive a wire retaining means 134 such as a common nail, bolt, cotter pin or other device. While the number and spacing of the wire attachment means 30 may be varied as necessary or desirable, in the presently preferred embodiment there are 12 such means spaced apart approximately 2 to 4 inches along the entire length of the post portion 26.

Figure 21:
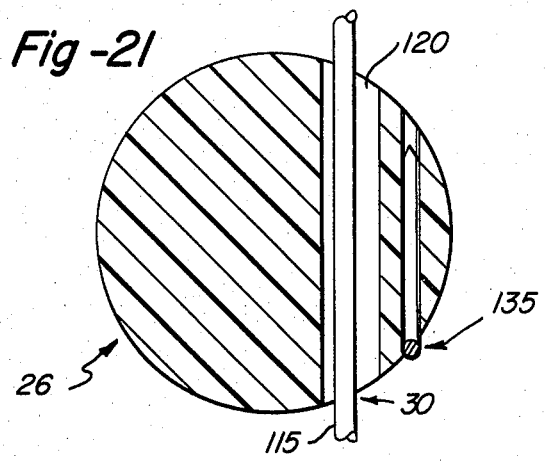
FIG. 21 is a cross-sectional view taken along line 21—21 in FIG. 20.
Figure 20:
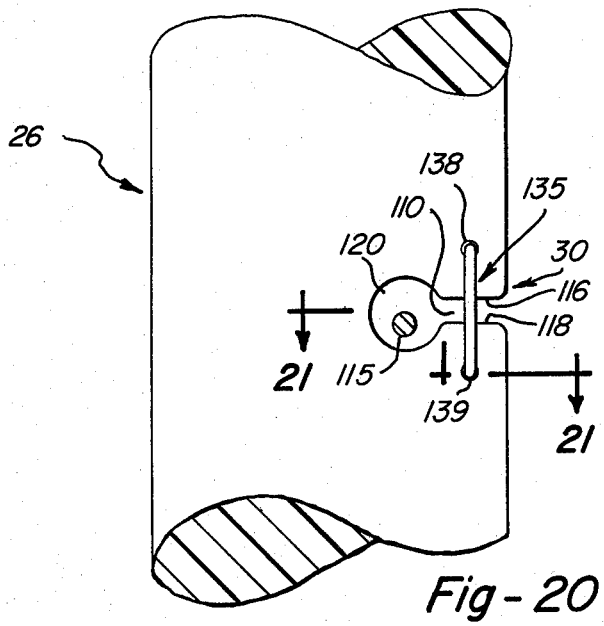
FIG. 20 is a side elevational view of an intermediate fence post portion having another alternative wire attachment means device.
Figure 5:
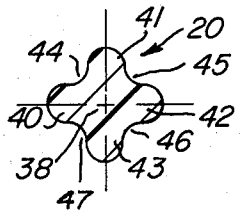
FIG. 5 is a cross-sectional view taken along line 5—5 in FIG. 2.

Referring to FIGS. 20 & 21, another alternative form of wire attachment means 30 the flange portions 100, 101 of FIGS. 17–19 are removed so that the wire insertion slot 110 is defined only by the opposed radially inwardly extending surfaces 116, 118 in post portion 26 which intersect the laterally extending wire retaining circular slot means 120 as previously described. A conventional U-shaped staple device 135 has leg portions 136, 137, which may be smooth or preferably serrated, of larger diameter than laterally extending mounting holes 138, 139 so as to be frictionally retained therewithin to prevent removal of wire 115 and separation of surfaces 116, 118 after insertion of the wire and the staple.

Referring now to FIGS. 13–16, an alternative form of the wire attachment means 30 comprises a pair of integral outwardly extending slightly resiliently deflectable axially spaced flange portions 140, 141 having flat parallel laterally spaced side surfaces 142, 143 & 144, 145 which are coplanar with the diametrically opposite surfaces 106, 108 of the cylindrical core 96. Flange portions 140, 141 are separated by a wire insertion slot 146 defined by opposed flat parallel flange surfaces 147, 148 which are preferably spaced apart a distance slightly less than the diameter of a fence wire to be inserted therebetween, and opposed radial inwardly extended surfaces 149, 150 in post portion 26 which intersect an axially and laterally extending wire retaining slot means 151 having a vertical center line 152 located at, FIG. 16, or adjacent to, FIG. 13, the central post axis 69. Slot means 151 comprises a vertically extending inner surface 153 and a pair of opposed vertically extending outer surfaces 154, 155 spaced outwardly thereof a distance greater than the diameter of a wire 156 to be received therebetween, and a pair of opposed rounded end surfaces 157, 158, spaced apart a suitable distance, e.g. ½ inch, to enable limited upward and downward displacement of the wire therewithin to accommodate stress on the wire due to variations in terrain and/or forces applied by animals and/or loads applied by ice and snow or the like. A pair of coaxial aligned pin holes 159, 160 are provided in flange portions 140, 141 to receive a wire retaining means 161 such as a common nail, bolt, cotter pin or other device.

As shown in FIG. 15, the upper end of post portion 26 may be provided with a wire attachment means 30 in the form of a pair of integral upwardly extending slightly resiliently deflectable laterally spaced flange portions 162, 163 defining a wire insertion slot means 164 and a wire retaining slot means 165 with opposite aligned pin holes 166, 167 adapted to receive a wire retaining means such as a cotter pin. Such an arrangement is particularly useful for temporary fencing situations involving the use of only one wire and may be employed with or without other wire attachment means 30 mounted along the side of the post portion 26.

The Road Marker & Sign Post Embodiment

Referring now to FIGS. 8–11, the road marker and sign post embodiment of the invention is of generally similar construction as the previously described fence post embodiment except as hereinafter described in further detail.

The lower ground penetrating shaft means portion 20 has a solid core 170 of cylindrical cross-section of suitable diameter, e.g. approximately ½ inch and terminates in a tapered solid core tip portion (not shown) having a rounded end surface as previously described. The driving head means portion 23 comprises an elongated conically tapered enlarged solid core portion 174 having a suitable taper, e.g. approximately 30° relative to the central longitudinal post axis 175 with a suitable length, e.g. approximately 2¾ inches, and providing a conical peripheral surface 176 of ½ inch lowermost diameter and 3½ inches uppermost diameter. A cylinrical solid core head portion 177 of suitable diameter, e.g. 3½ inches, and suitable length, e.g. ½ inch, has a flat annular upper side abutment surface 178 as previously described. The stabilizer means portion 24 comprises a pair of radially outwardly extending diametrically opposite flange portions 180, 181 having rounded upper end surfaces 182, 183 merging with side surface 178. Side surfaces 184, 185 extend parallel to central post axis 175 and lower end surfaces 186, 187 are inwardly inclined at an angle of approximately 40° relative to axis 175 to be connected to shaft portion 20 approximately 6 inches from surface 178. The length of shaft portion 20 between the intersection 189 with conical head portion and tip end surface is approximately 7¼ inches.

The post means portion 26 comprises a cylindrical solid core post portion 190 of suitable length, such as approximately 3 feet, which terminates in a relatively short length, e.g. 17 inches, integrally connected sign mounting plate portion 192 of rectangular peripheral and cross-sectional configuration defined by flat parallel relatively wide, e.g. 1½ inches, side surfaces 194, 196 and flat parallel relatively narrow width, e.g. 1–4 inch edge surfaces 198, 200 in which mounting holes 34, 35, 36 are located to mount a road sign 202 by suitable fastening devices 204, 206, 208. The reflector mounting means portion 32 may be integrally formed at the upper end of plate portion 192, and in the illustrative embodiment, comprises an annular support plate portion 210 having opposite flat parallel side surfaces 212, 214 and an annular rim portion 216 defining annular mounting cavities 218, 220 for annular reflector members 222, 224 which may be fastened wherein by a rivet or bolt type fastening device 226 extending through a central bore 228. The size, shape and configuration of the reflector mounting means portion may be varied as necessary or desirable. For example, the reflector devices may be mounted directly on the mounting plate portion 192 in the manner of the road sign 202 without use of a special reflector attachment means portion 32 or the attachment means portion 32 may comprise a suitable slot means (not shown) for slidable insertion and retention of the reflector device. In addition, the post may be made with reflective material or painted or coated or covered with reflective material.

Manufacture and Operation

The posts of the present invention may be made by presently known plastic molding apparatus and processes involving the use of liquid polymeric materials, such as polyurethane, which may be relatively quickly formed in relatively inexpensive mold apparatus. The use of polyurethane material is particularly advantageous because of the characteristics of polyurethane material which provides many of the attributes of conventional metallic post materials without having many of the disadvantages thereof. For example, the posts of the present invention are preferably made from a polyether or polyester based thermosetting urethane castable polymer material, such as manufactured and sold by The Upjohn Company under the trademark RIMTHANE, designed for processing in reaction injection molding equipment with high pressure impingement mixing heads. The material has high reactivity resulting in fast gel times, e.g. 8 to 15 seconds, and fast in-mold times, e.g. ½ to 2 minutes at 120° F. (49° C.) with relatively high post-cure times, e.g. 1 to 2 hours, at elevated temperatures, e.g. 250° F. (121° C.). The elastomeric urethane material has excellent mechanical properties including abrasion and mar resistance, low density, load bearing capability, chemical and weathering resistance, structural integrity over a wide temperature range, impact resistance, tensile strength, tear and compressive strength, low compression set, hydrolytic stability, resilience and memory, toughness with a high decree of elasticity.

The desired physical characteristics of apparatus made in accordance with the present invention may be varied as necessary or desirable by dimensional changes and/or the use of other materials or combinations of materials. For example, if additional stiffness is desired, suitable amounts of fiberglass material, e.g. approximately 50% by weight, may be added to the polyurethane material or the cross-sectional diameters or thicknesses of the post portions may be increased with the use of foaming techniques to provide voids to maintain lightweight and low material costs.

The posts of the present invention may be used in the same manner and for the same purposes as conventional metal posts. The posts may be driven into any kind of ground cover into which a metal post may be driven by use of a driving device such as a length of metal pipe 58 which is telescopically mounted over the mounting post portion 26 in driving engagement with the abutment surfaces 66 or 178. When driving force is applied to those surfaces, the ground penetrating tip portion 22 and the shaft portion 20 may be forced into the ground until the surfaces 58 or 178 are substantially flush with the upper ground level. The generally conical driving head portions facilitate forcible entry into the ground. The preferred use of alternate rib and groove portions provides maximum surface area facilitating both post driving and post retention in the ground. The use of stabilizer means 24 assures post retention and proper location of the posts in desired positions in the ground. The wire attachment means and the road sign and reflector mounting means enable easy reliable attachment and removal of fence wires or the like and road signs and reflectors or the like after the posts have been driven into the ground. While illustrative and presently preferred wire attachment means and road sign and reflector mounting means have been described, it is to be understood that other such means may be employed as necessary or desirable such as, for example, a conventional scalloped rib and wire attachment arrangement of the type illustrated in U.S. Pat. No. 3,080,149. In addition, the illustrative dimensional characteristics of the posts may be varied as necessary or desirable. For example, the lengths and diameters may be decreased or increased, depending on particular usages of the posts.

Since the inventive concepts of the illustrative and presently preferred embodiments of the invention may be various combined, modified and rearranged, it is intended that the appended claims be construed to include alternative embodiments of the invention and various combinations and arrangements thereof except insofar as limited by the prior art.

The invention claimed is:

1. Post apparatus made of one piece of molded polymeric material and comprising:

a vertically upwardly extending elongated post means portion for supporting apparatus mounted thereon;

a driving head means portion connected to and mounted below the lower end of said post means portion for application of force thereto without application of force to the upper end of said post means portion for forcibly driving the post apparatus into the ground;

stabilizing flange means portions mounted on said driving head means portion below the lower end of said post means portion for stabilizing and supporting the post apparatus in a vertical attitude after being forcibly driven into the ground;

a ground penetrating shaft means portion connected to and mounted below said stabilizing means portion for initial penetration of the ground during forcible driving of the post apparatus into the ground; and said driving head means portion comprising an upwardly facing force applying surface means radially outwardly spaced from and extending circumferentially about said post means portion for receiving driving force applied to said head means portion, and a downwardly inwardly tapered elongated core portion extending between said force applying surface means and said ground penetrating shaft means portion.

2. The invention as defined in claim 1 and wherein said ground penetrating shaft means portion comprising:

an elongated solid core portion, and a plurality of alternate elongated rib means and groove means on the periphery of said solid core portion for facilitating entry into the ground.

3. The invention as defined in claim 2 and wherein said driving head means further comprising:

a plurality of alternate elongated rib means and groove means converging and merging with said rib means and said groove means on said penetrating shaft portion for facilitating entry into the ground.

4. The invention as defined in claim 3 and wherein:

said core portion of said driving head means being approximately the same length or of lesser length than said penetrating shaft portion.

5. The invention as defined in claim 4 and wherein:

said post means portion being at least in part of circular cross-section;

said driving head means having a generally cylindrical uppermost portion having a diameter substantially greater than the diameter of said post means portion;

said elongated solid core portion of said driving head means portion being of generally conical shape; and said penetrating shaft portion being of generally circular cross-section and having a diameter approximately equal to or less than the diameter of said post means portion.

6. The invention as defined in claim 5 and wherein said penetrating shaft portion further comprising:

a lowermost penetrating tip portion having a diameter or less than the diameter of said penetrating shaft portion.

7. The invention as defined in claim 6 and wherein said stabilizing flange means portions comprising:

a pair of diametrically opposed flange portions extending downwardly from said force applying surface means.

8. The invention as defined in claim 7 and wherein:

said diametrically opposed flange portions having a radial width greater than the radial width of said force applying surface means.

9. The invention as defined in claim 8 and wherein:

said diametrically opposed flange portions having an axial length greater than their radial width.

10. The invention as defined in claim 9 and further comprising:

a pair of diametrically opposed support rib portions located between said diametrically opposed flange portions and extending from said force applying surface means to said penetrating shaft portion.

11. The invention as defined in claim 10 and further comprising:

concavely curved downwardly inwardly tapered connecting surfaces extending between each of said support rib portions and each of said flange portions.

12. The invention as defined in claim 11 and wherein:

said rib portions having a maximum radial width equal to or less than the radial width of said force applying surface means.

13. The invention as defined in claim 1 and further comprising:

device attachment means mounted on said post means portion for attachment of devices thereto.

14. The invention as defined in claim 13 and wherein said device attachment means further comprising:

wire attachment means for attachment of a wire.

15. The invention as defined in claim 13 and wherein said device attachment means further comprising:

sign device attachment means for attachment of a sign device.

16. The invention as defined in claim 15 and wherein said device attachment means further comprising:

a reflector attachment means for attachment of a reflector device.

17. The invention as defined in claim 14 and wherein said wire attachment means comprising:

a plurality of wire attachment devices mounted in axially spaced relationship along said post means portion.

18. The invention as defined in claim 14 and wherein said wire attachment means comprising:

a wire attachment device mounted on the upper end of said post means portion.

19. The invention as defined in claim 17 and wherein each of said wire attachment devices comprising:

radially outwardly extending flange means integrally connected to said post portion and having flat parallel laterally spaced side surfaces for receiving a wire to be held on said post means portion.

20. The invention as defined in claim 17 and wherein each of said wire attachment devices further comprising:

a pair of axially spaced flange portions extending radially outwardly relative to said post means portion;

a laterally extending wire insertion slot between said flange portions; and a wire retention slot in said post means portion intersecting said wire insertion slot.

21. The invention as defined in claim 20 and further comprising:

a pair of coaxial aligned pin holes in said flange portions constructed and arranged to receive a separate wire retaining pin device associated with each of said wire attachment devices.

22. The invention as defined in claim 20 and wherein:

said wire receiving slot having a width less than the wire to be inserted therethrough; and said flange portions being resiliently outwardly flexible to enable insertion of the wire through said insertion slot.

23. The invention as defined in claim 20 and wherein:

said wire retention slot having a size and configuration larger than the size and configuration of the wire to be retained therewithin.

24. The invention as defined in claim 23 and wherein:

said retention slot being elongated and having a width greater than the diameter of the wire and a length greater than the width.

25. The invention as defined in claim 15 and wherein said post means portion comprising:

a part of polygonal cross-sectional configuration having opposite flat side surfaces for mounting of a sign or reflector type device thereon.

26. The invention as defined in claim 25 and further comprising:

mounting means integrally formed in said part of said post means portion for removably mounting the sign or reflector type device.

27. The invention as defined in claim 25 and further comprising:

a reflector mounting portion located at the upper end of said post means portion.

28. The invention as defined in claim 13 and wherein the post apparatus being made of more than 50% by weight of molded polyurethane materials.

29. The invention as defined in claim 17 and wherein each of said wire attachment devices comprising:

radially outwardly and laterally extending wire insertion slot means in said post means portion for inserting a wire member;

a laterally extending wire retention slot means in said post means intersecting said wire insertion slot means for supporting the wire member; and laterally extending hole means in said post means portion located on opposite sides of said wire insertion slot means for receiving a staple type fastening device to prevent removal of the wire member.

* * * * *